United States Patent [19]

Bury et al.

[11] 4,017,141

[45] Apr. 12, 1977

[54] CONNECTORS WITH PRIMARY AND SECONDARY LOCK STRUCTURE

[76] Inventors: Allen J. Bury, 400 Etowah, Prospect Heights, Ill. 60070; William D. Gruhn, Jr., 408 Hillcrest Lane, Lombard, Ill. 60148

[22] Filed: May 23, 1973

[21] Appl. No.: 363,310

[52] U.S. Cl. ..... 339/217 S; 339/196 M

[51] Int. Cl.[2] ..... H01R 9/08

[58] Field of Search ..... 339/63, 196 M, 206–210, 339/217

[56] References Cited

UNITED STATES PATENTS

| | | | |
|---|---|---|---|
| 3,002,170 | 9/1961 | Clouthier | 339/217 T X |
| 3,059,213 | 10/1962 | Lalonde | 339/217 S X |
| 3,172,721 | 3/1965 | Kelly | 339/217 S |
| 3,178,673 | 4/1965 | Krehbiel | 339/217 S |
| 3,293,591 | 12/1966 | Mayer | 339/107 |
| 3,399,373 | 8/1968 | Maki et al. | 339/217 R X |
| 3,569,900 | 3/1971 | Uberbacher | 339/217 S X |
| 3,573,720 | 4/1971 | Reynolds | 339/217 R |
| 3,668,615 | 6/1972 | Bury | 339/206 R |
| 3,680,035 | 7/1972 | Teagno et al. | 339/210 M X |
| 3,693,134 | 9/1972 | Trevisiol | 339/59 M |
| 3,732,529 | 5/1973 | Weisenburger | 339/210 M X |
| 3,745,515 | 7/1973 | Michaels | 339/206 P X |

FOREIGN PATENTS OR APPLICATIONS

| | | | |
|---|---|---|---|
| 1,166,188 | 6/1958 | France | 339/217 S |
| 1,492,712 | 7/1967 | France | 339/217 TP |
| 364,826 | 11/1962 | Switzerland | 339/195 M |

*Primary Examiner*—Lawrence J. Staab

[57] ABSTRACT

Electrical connectors include an insulating housing having terminal-receiving cavities in which conductive terminals are inserted and retained. When a terminal is inserted to a home position in a cavity, a primary lock structure formed on the terminal and on the wall of the cavity is effective to retain the terminal in place. A secondary lock structure is provided by a hinged door of the housing. In order to prevent inadvertent incomplete terminal insertion, the door cannot be closed until the terminal is fully inserted into the home position. If the terminal is spaced substantially from the home position, the terminal blocks movement of the door to its closed position. If the terminal is near the home position, the door advances the terminal into the home position.

4 Claims, 20 Drawing Figures

CONNECTORS WITH PRIMARY AND SECONDARY LOCK STRUCTURE

The present invention relates to electrical connectors including insulating housings containing inserted conductive terminals.

Following the development of so-called pin terminal connectors such as disclosed in U.S. Pat. Nos. 3,178,673 — Krehbiel and 3,465,279 — Krehbiel, connectors of this type have gained wide acceptance in the automotive, appliance, home entertainment and business machine industries and in many other fields where convenient and rapid electrical connection between wire conductors is desirable. Such pin terminal connectors may include a plug or a socket housing having one, or usually several, terminal receiving cavities into which male or female terminals are inserted. Each terminal is normally precrimped to a wire conductor, and then inserted into a housing cavity where it is retained in place by a locking structure. Typically the locking structure may include resilient tangs and spaced projections on the terminal engaging spaced shoulders of the housing located at the ends of a bore portion of the cavity. Mating plug and socket housings are joined in order to interconnect mating male and female terminals mounted in the housings. Similar housings can also be joined directly with other terminal supporting devices.

Although connectors of the type disclosed in the above identified patents have proven highly successful, difficulties can be encountered in some instances in obtaining reliable interconnections between terminals. For example, during assembly of a connector it may happen that a terminal is inadvertently not fully inserted into its housing cavity. In this event, the locking structure may not be effective securely to hold the terminal in place. When the terminal is joined with a mating terminal, the insecurely mounted terminal can be pushed out of position so that the desired electrical connection is not made. Moreover, even if the connection is made initially, the terminal can subsequently work loose and cause a faulty or intermittent connection.

A primary object of the present invention is to provide electrical connectors wherein it is assured that the connector terminals are securely locked in place in terminal-receiving cavities of the housing upon assembly of the connector. Other important objects are to provide connectors including a primary lock structure for holding each terminal in place together with a secondary lock structure; to provide connectors wherein the secondary lock structure includes a movable housing part which cannot be closed if the terminal is not properly inserted into the housing; and to provide connectors wherein the movable portion advances a partly inserted terminal to the locked position upon closing.

In brief, the above and other objects of the present invention may be achieved through the provision of an electrical connector comprising a housing formed of insulating material and having at least one terminal-receiving cavity. The cavity includes an entrance region through which a conductive terminal is inserted to a home position. The terminal and the housing are provided with a primary lock structure for retaining the terminal in place when the terminal is inserted to the home position. A secondary lock structure is provided for obstructing the entrance region of the cavity after insertion of the terminal.

In accordance with a feature of the invention, the secondary lock structure includes an integral door portion of the housing movable between an open position wherein the terminal may be inserted and a closed position wherein a portion of the door obstructs the cavity entrance region. The terminal includes projections movable in guide grooves in the housing to orient the terminal. If the terminal is partly inserted and is not near the home position, the door portion of the housing is blocked by a terminal projection and cannot be closed. If the terminal is near the home position, the door engages the projection and advances the terminal to the home position.

The invention and its objects and advantages may be best understood with reference to the following detailed description of illustrative embodiments of the invention shown in the accompanying drawings, wherein.

Figure 1:
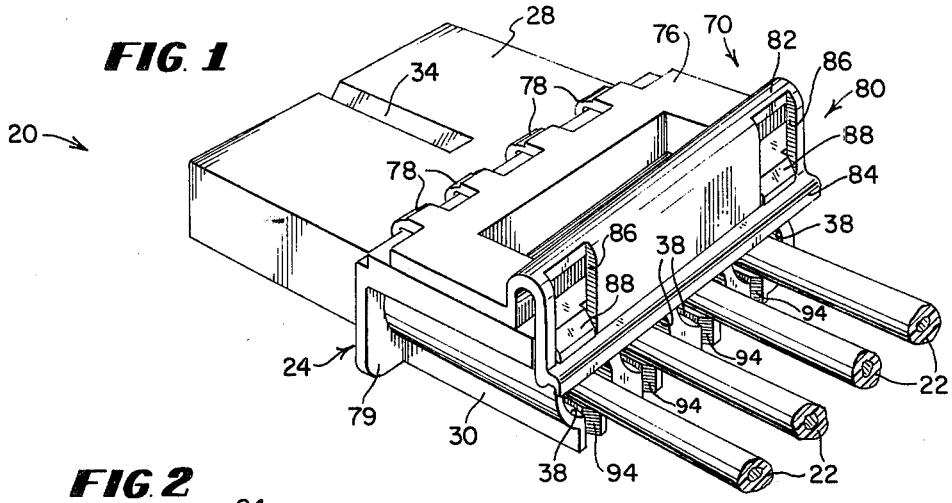
FIG. 1 is a perspective view of an electrical connector contructed in accordance with the present invention.
Figure 2:
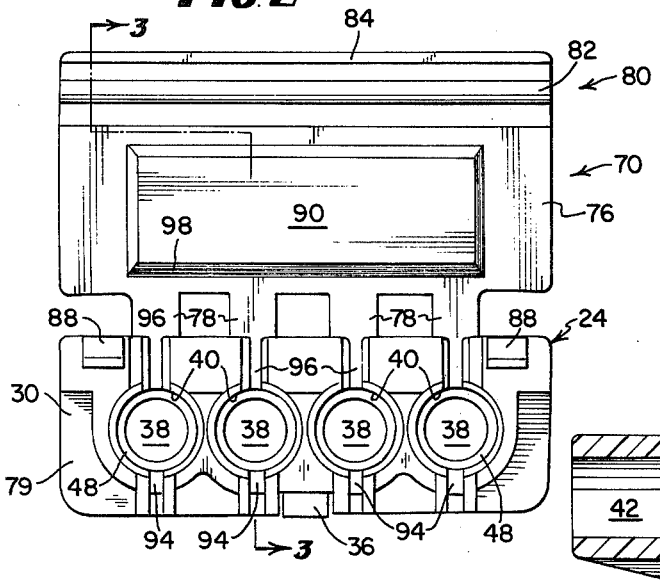
FIG. 2 is an end elevational view of the housing of the conenctor of FIG. 1 with the housing door portion in the open position.
Figure 3:
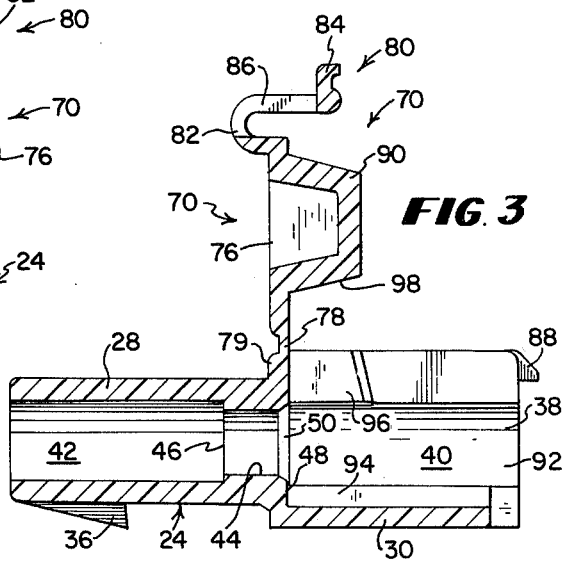
FIG. 3 is a sectional view of the housing of FIG. 2 taken along the line 3—3 of FIG. 2.
Figure 4:
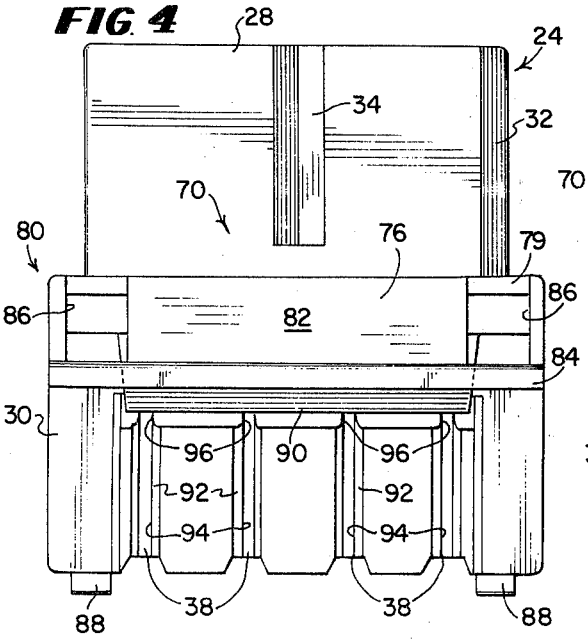
Figure 5:
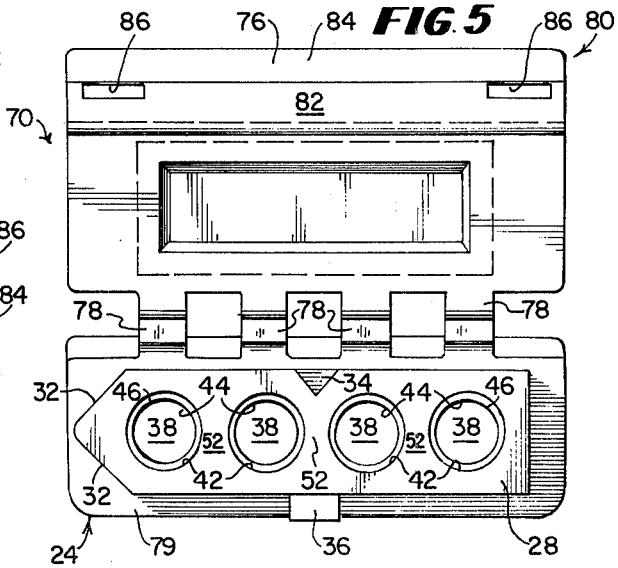
Figure 6:
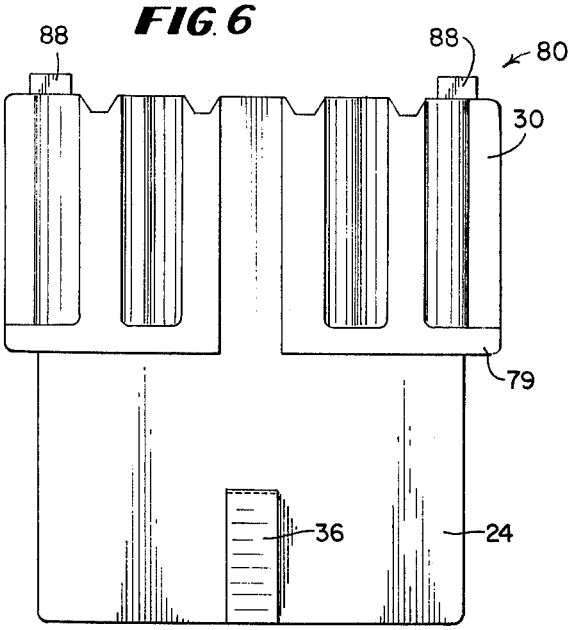
Figure 7:
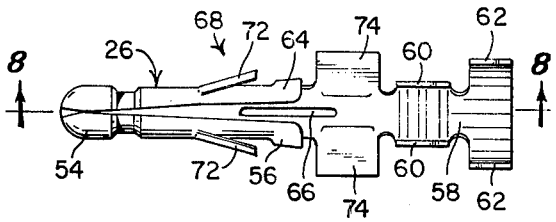
Figure 8:
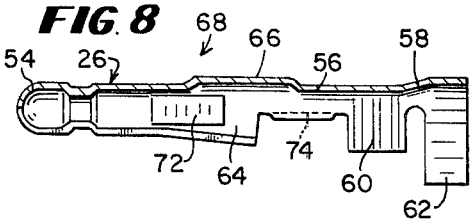
Figure 13:
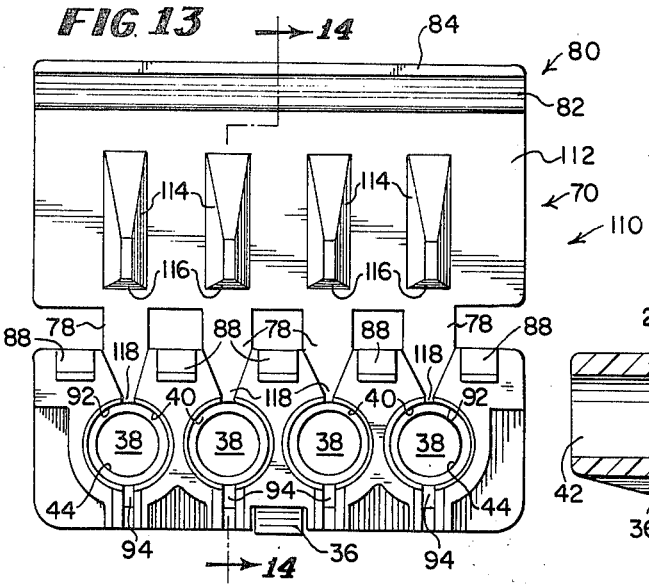
Figure 14:
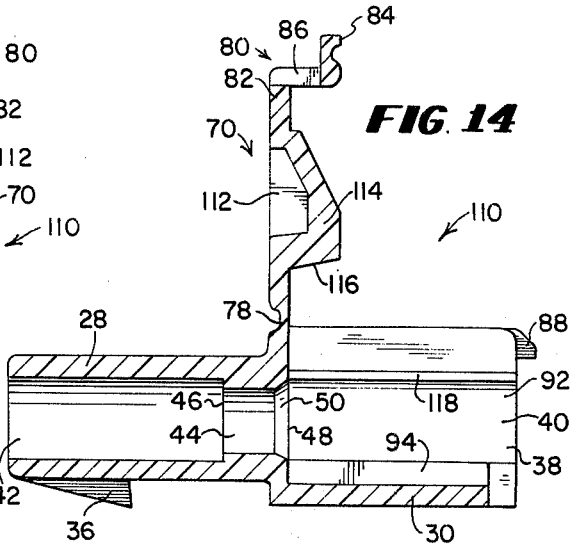
Figure 15:
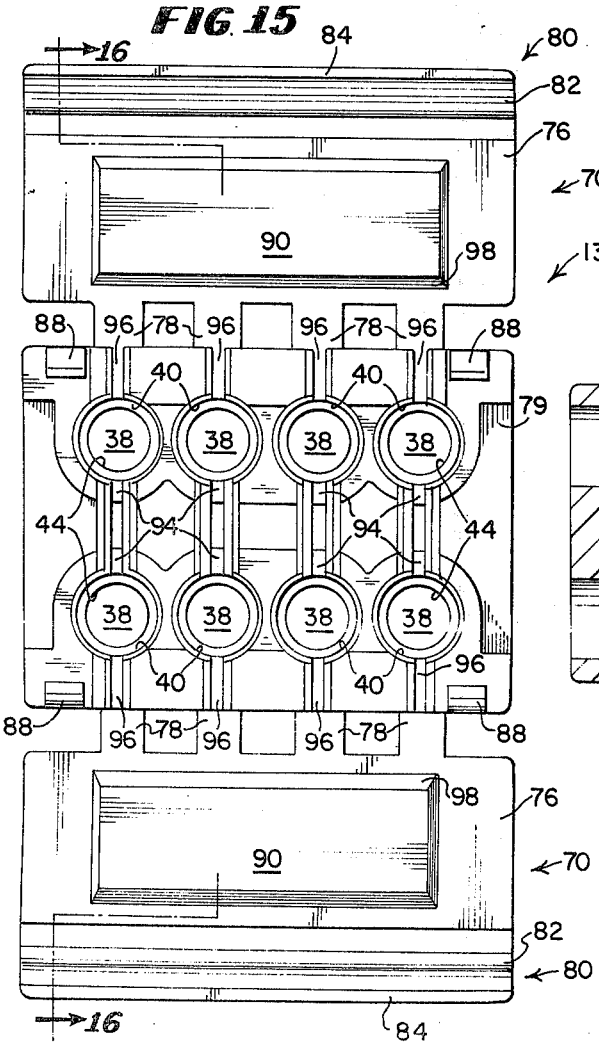
Figure 16:
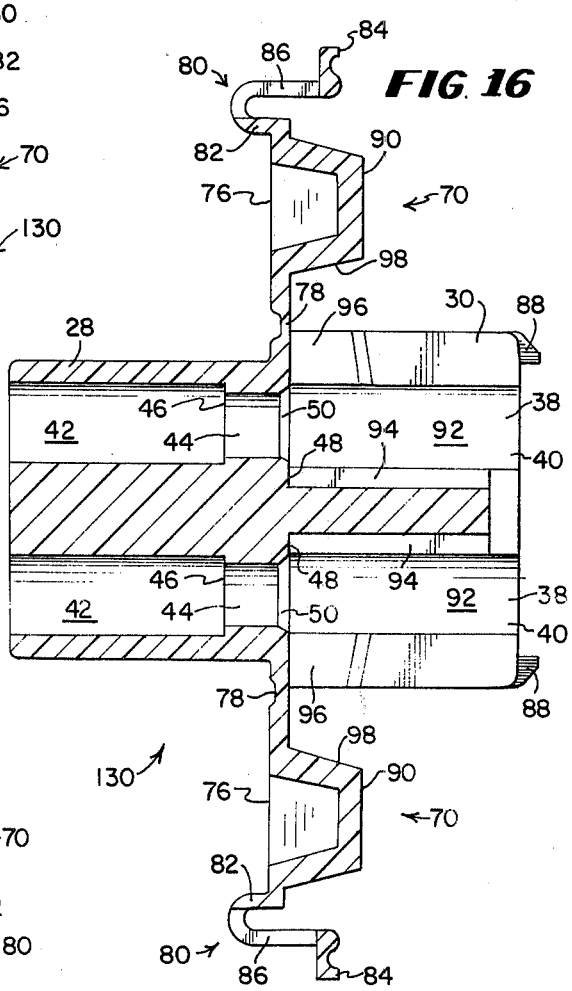
Figure 17:
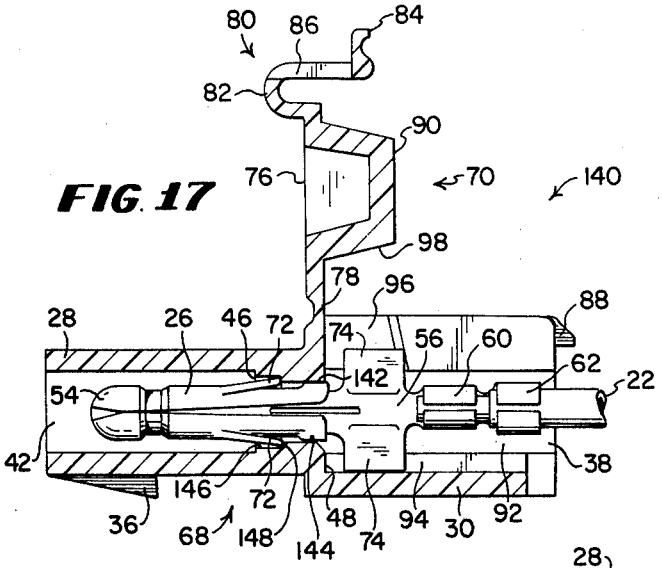
Figure 18:
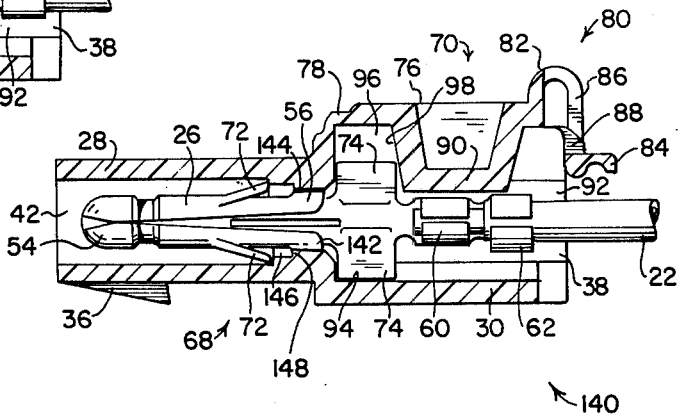
Figure 19:
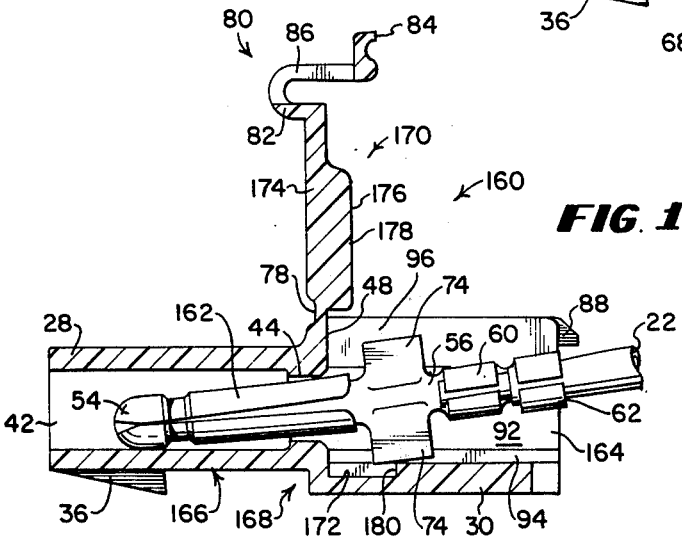
Figure 20:
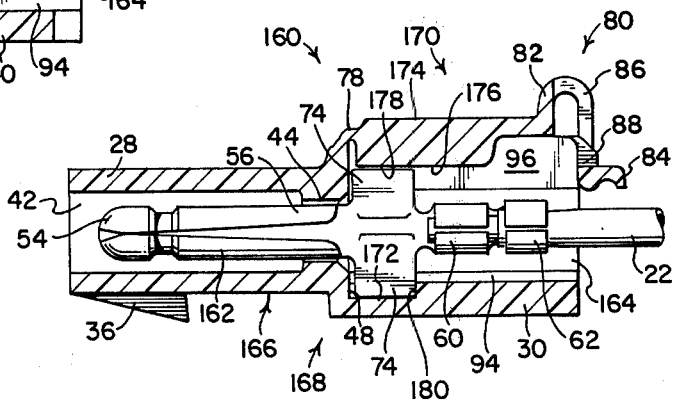

FIG . 4 is a top view of the housing of FIG. 2;

FIG. 5 is an end view of the housing of FIG. 2 illustrating the end of the housing opposite that shown in FIG. 3;

FIG. 6 is a bottom view of the housing of FIG. 2;

FIG. 7 is an elevational view of a terminal of the connector illustrated in FIG. 1 prior to crimping of the terminal to a wire conductor;

FIG. 8 is a sectional view of the terminal of FIG. 7 taken along the line 8—8 of FIG. 7;

FIGS. 9–12 are sectional views similar to FIG. 3 illustrating the housing and terminal at various times during assembly of the connector of FIG 1;

FIG. 13 is an end view of the housing of an electrical connector comprising an alternative embodiment of the invention;

FIG. 14 is a sectional view of the housing shown in FIG. 13 taken along the line 14—14 of FIG. 13;

FIG. 15 is an end view of a housing of an electrical connector comprising another alternative embodiment of the invention;

FIG. 16 is a sectional view of the housing of FIG. 15 taken along the line 16—16 of FIG. 15;

FIG. 17 is a sectional view of an electrical connector comprising another alternative embodiment of the invention and illustrating a terminal and the housing in an intermediate assembled condition;

FIG. 18 is a view similar to FIG. 17 illustrating the connector of FIG. 17 in the final assembled condition;

FIG. 19 is a sectional view of an electrical connector comprising another embodiment of the invention and illustrating a terminal and the housing during assembly of the connector; and FIG. 20 is a sectional view similar to FIG. 19 illustrating the connector of FIG. 19 in the fully assembled condition.

Having reference now to the drawings and initially to FIGS. 1–12, there is illustrated an electrical connector constructed in accordance with the principles of the present invention and designated as a whole by the reference numeral 20. Connector 20 serves to facilitate the interconnection of a group of wire conductors 22 (FIG. 1) with other wire conductors or with other electrical devices. In general, the connector 20 includes a housing generally designated as 24 enclosing a group of terminals each generally designated as 26 to which the wire conductors 22 are secured.

Although the connector 20 could take other forms the illustrated device is a plug connector, and housing 24 includes a plug portion 28 extending from a body portion 30. Plug portion 28 is of conventional construction and includes bevelled corner sections 32, a groove 34, and a generally wedge-shaped protuberance 36 for providing indexing and latching functions when the plug connector 20 is joined with a mating socket connector or other equivalent device. It should be understood that the principles of the invention are applicable to socket connectors as well as to plug connectors, and to other types of connectors including insertable conductive terminals.

In order to receive terminals 26, the housing 24 is provided with a row of four terminal-receiving cavities similar to one another and each designated as a whole by the reference numeral 38. Connectors of the present invention may be provided with more or fewer cavities 38 in order to accommodate more or fewer terminals 26 depending upon the use to which the connector is to be put. In general, each cavity 38 includes an entrance region 40 disposed in the body portion 30 of the housing 24 and a contact receiving region 42 located within the plug portion 28 of the housing 24. A bore portion 44 of reduced diameter extends between the entrance region 40 and the contact receiving region 42 and is bounded on its inner and outer ends by inner and outer shoulders 46 and 48. A bevel 50 is located at the junction of bore 44 and the outer shoulder 48 in order to facilitate insertion of a terminal into the cavity 38. In the illustrated arangement wherein the connector 20 comprises a plug connector, the contact receiving regions 42 of the cavities 38 are separated from one another by wall portions 52 (FIG. 5). It will be understood by those skilled in the art that in a socket connector, the cavities 38 although similar in other respects may include a single contact receiving region common to several cavities.

Each terminal 26, as best illustrated in FIGS. 7 and 8, includes a contact portion 54, a body portion 56 and a wire crimp portion 58. Contact portion 54 comprises a male pin contact in the illustrated arrangement but it should be understood that the principles of the present invention are equally applicable to other contact configurations including female contacts of the type adapted to mate with the illustrated contact portion 54. Terminal 26 is of the type adapted to be precrimped to a wire conductor 22 prior to insertion into the terminal receiving cavity 38. Consequently, the wire crimp portion 58 of the terminal 26 includes a first pair of flanges 60 for crimping to a stripped end portion of a wire together with a second pair of flanges 62 for crimping to the insulation sheath of the wire conductor. The configuration of flanges 60 and 62 after crimping to a wire conductor 22 appears best in FIGS. 9–12.

When terminal 26 is inserted into a terminal receiving cavity 38 of the housing 24, the body portion 56 of the terminal is located in bore portion 44 of cavity 38. In order to stabilize the terminal 26 in cavity 38, the body portion 56 includes a generally cylindrical wall 64 preferably comprising an extension of contact portion 54. Wall 64 is flared or somewhat conical in shape, and in addition there is provided a stabilizing ridge or rib 66 so that upon insertion of the terminal 26, the wall 64 and rib 66 engage the wall of bore 44.

Pin terminals of the prior art commonly include a lock structure for retaining the terminals in terminal-receiving cavities. In accordance with an important feature of the present invention, there is provided a primary lock structure designated as a whole by the reference numeral 68 similar in some respects to locking structures used in the past. There is also provided in accordance with the invention a secondary lock structure designated by the reference numeral 70 which cooperates with the primary lock structure 68 and overcomes a problem existing with prior art arrangements in assuring that the terminal 26 is properly inserted into cavity 38 and securely retained therein.

With reference first to primary lock structure 68, the body portion 56 of each terminal 26 is provided with a pair of locking tangs 72 struck outwardly from wall 64 on opposite sides of the terminal. As the terminal is inserted through the entrance region 40 and through the bore portion 44 of cavity 38, the tangs 72 are resiliently compressed radially inwardly and move through the bore 44. When the terminal 26 reaches the fully inserted or "home" position illustrated in FIG. 10, the tangs 72 resiliently snap outwardly to engage the inner shoulder 46. In this manner, the tangs 72 prevent withdrawal of the terminal 26 from the cavity 38.

In order to limit insertion of the terminal 26, or prevent overinsertion of the terminal, the body portion 56 is provided with structure for engaging the inner shoulder 46 upon movement of the terminal to the home position. In the illustrated arrangement, this function is performed by a pair of wing-like projections 74 extending in opposite directions from body portion 56. Projections 74 perform other important functions in connection with the connector 20 of the present invention, and are described in greater detail below.

In prior art connectors including a locking structure similar to the primary lock structure 68, problems can arise leading to faulty electrical connections between the connector terminals and other mating terminals. Such connectors, including a number of terminals, may be used to terminate a number of wire conductors associated, for example, with a wiring harness. In the assembly of the connector, individual terminals crimped to different wire conductors may be inserted into the connector housing at various times and at spaced locations. It may occur that one or more terminals of the connector is not fully inserted into the housing to the home position. As a consequence, the locking tang or tangs of the terminal may not clear the bore portion of the terminal-receiving cavity so that the tang or tangs does not snap outwardly, positively to lock the terminal in place.

Even though a terminal is almost in the proper home position following assembly, problems can arise when the connector is joined with a mating connector or other device. The force applied to the insecurely mounted terminal during mating with another terminal can push the insecurely mounted terminal outwardly in the housing so that it is moved away from the home position. This can cause an open circuit between the insecurely mounted terminal and its counterpart. Also, even if a connection is initially established, shocks, vibrations and the like can cause an insecurely mounted terminal to gradually work loose resulting in a faulty or intermittent electrical connection.

Figure 10:
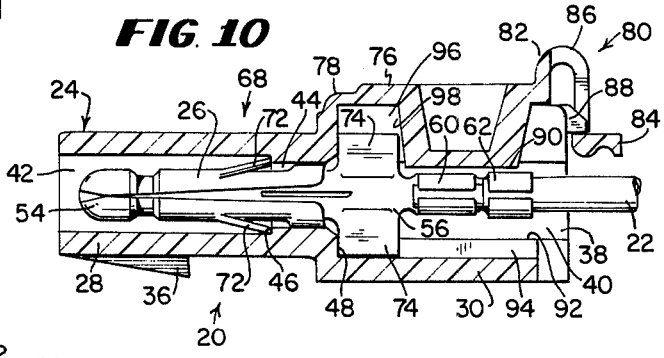

In order to prevent such problems, the connector 20 of the present invention is provided with the secondary lock structure 70. In the embodiment of the invention illustrated in FIGS. 1–12 of the drawings the secondary lock structure 70 includes a movable portion of housing 24, and specifically a door 76 comprising one wall of the body portion 30 of the housing. Door 76 is movable between an open position (FIGS. 2–5, 9 and 11) and a closed position (FIGS. 1 and 10). Door 76 is hinged to the remainder of housing 24 by means of integral hinges 78 defining a door pivot axis lying along a flange portion 79 of housing 24 separating the plug portion 28 and the body portion 30. The pivot axis extends in a direction perpendicular to the cavities 38 and thus perpendicular to the direction of insertion of the terminals 26.

In order releasably to hold the door 76 in the closed position, there is provided a latch arrangement generally designated as 80. The outer edge of door 76 includes a generally U-shaped resilient wall portion 82 terminating in a lip 84 overlying the end wall of the housing 24. A pair of latching slots 86 are disposed near the ends of wall portion 82 in alignment with a pair of latching protuberances 88 extending from the end wall of the housing 24. The U-shaped wall portion 82 is somewhat resilient, and as the door 76 is moved from the open to the closed position, lip 84 engages the upper surfaces of protuberances 88. The interengaging surfaces are shaped to provide a cam action for forcing the wall portion 82 outwardly and permitting the lip 84 to ride over the protuberances 88. In the fully closed position, the wall portion 82 returns to its initial position so that the lip 84 underlies the protuberances 88. In order to re-open the door 76, the lip 84 provides a convenient place to grasp the door 76 and pull it upwardly and outwardly.

In accordance with the present invention, when the door 76 is in the closed position illustrated in FIGS. 1 and 10, the entrance regions 40 of the terminal receiving cavities 38 are obstructed. More specifically, the door 76 is provided with a downwardly extending projection 90 and, as best seen in FIG. 10, when the door 76 is closed, the projection 90 is disposed partly within each entrance region 40. In the embodiment of the invention illustrated in FIGS. 1–12, the protuberance 90 is in the form of a single bar-like section having a length sufficient so that the single section 90 obstructs the entrance region 40 of each of the cavities 38.

The entrance regions 40 in accordance with an aspect of the present invention are contoured in order to orient inserted terminals 26 in such a way that the secondary lock structure 70 is permitted to function. More specifically, each entrance region 40 includes generally circular side walls (FIGS. 2 and 3) complementary in shape to the body portion 56 of the terminal 26. A guide slot 94 extends in a downward direction from each circular wall portion 92. A similar guide slot 96 extends in an upward direction opposite the guide slot 94. Preferably a bevel is provided at the outer edges of the walls 92 and the slots 94 and 96 in order to facilitate entry of a terminal 26 into the entrance regions 40. Lower slot 94 extends substantially throughout the length of the entrance region 40. Because material is removed from the portion of the housing 24 above the entrance region 40 to accommodate the door projection 90, the upper slots 96 extend from the outer shoulder 48 for only a portion of the length of the entrance region 40.

As a terminal 26 is inserted into the entrance region 40, the wing-like projections 74 are received into the lower and upper slots 94 and 96. With reference to FIG. 8, it can be seen that the projections 74 both lie in a plane generally including the central axis of the terminal 26. Thus, the terminal 26 may be inserted in either of two positions rotated 180° from one another. As the terminal 26 is further inserted toward the home position, the projections 76 are guided by the slots 94 and 96 to maintain the terminal 26 in the desired angular position with one of the wing-like projections 74 extending upwardly toward the door 76.

Turning now to a description of the function of the secondary lock structure 70, if a terminal 26 is properly inserted fully to the home position, the locking tangs 72 of the primary lock structure 68 expand radially outwardly as described above to engage the inner shoulder 46 and securely hold the terminal 26 in place. Door 76 may be closed after full insertion as illustrated in FIG. 10 with the door projection 90 moving into place directly behind the upper wing-like projection 74 of the terminal. Normally the terminal is held in place by the primary lock structure. However, in the event of malfunction of the primary lock structure due to, for example, failure of the tangs 72 to move outwardly for any reason, the secondary lock structure 70 is capable of retaining the terminal 27 in the home position.

Figure 9:
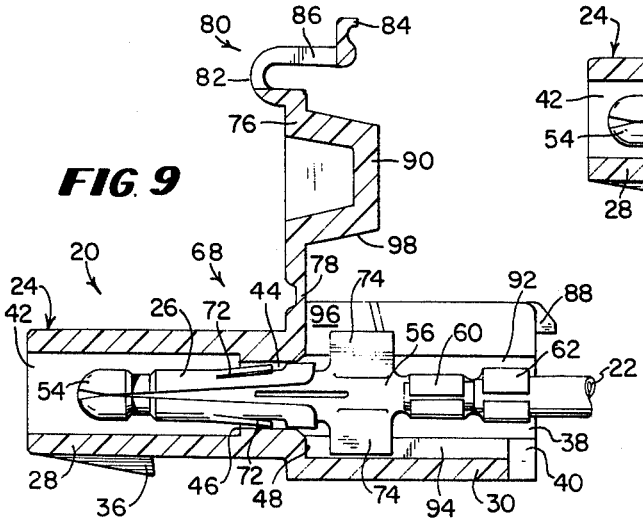

In the event of inadvertent underinsertion of a terminal 26, the secondary lock structure 70 is effective in combination with the primary lock structure 68 to assure that the terminal is properly mounted before use of the connector 20. More specifically, if the terminal 26 is inserted to a position closely adjacent the home position as illustrated in FIG. 9, the secondary lock structure 70 functions to complete the insertion of the terminal as door 76 is closed. The door projection 90 is provided with a camming surface 98 engageable with a cooperating rear surface of the upper terminal projection 74 to advance the terminal to the home position as the door 76 is closed. When the door 76 is moved to the fully closed position of FIG. 10, the camming surface 98 pushes terminal 26 inwardly so that the primary lock structure 68 functions securely to mount the terminal.

Figure 12:
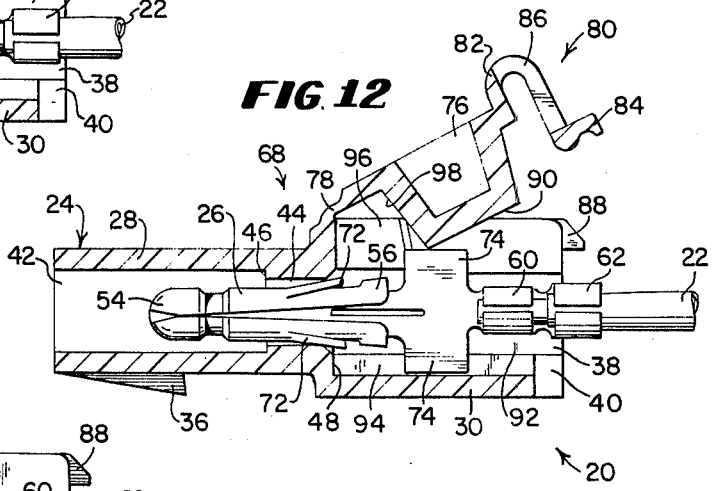
Figure 11:
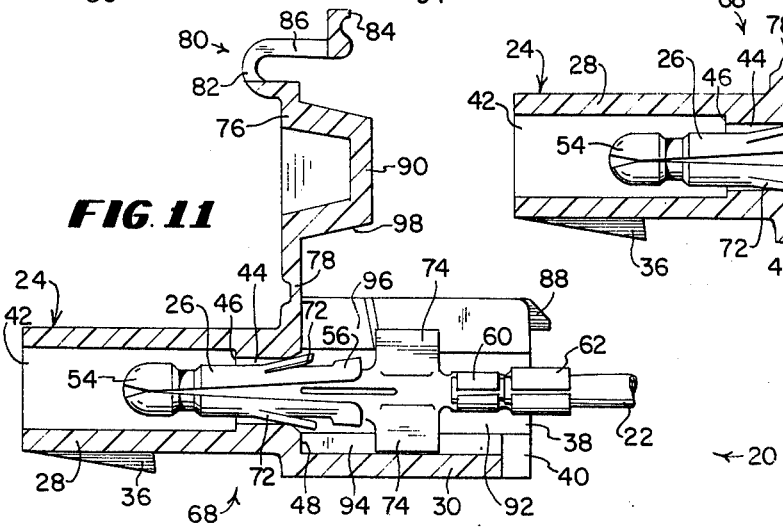

Conversely, if a terminal 26 is underinserted to a greater extent so that the terminal is not closely adjacent the home position, it is not possible to complete the assembly of the terminal. More specifically, if the terminal 26 is positioned more than a predetermined distance from the home position as illustrated in FIG. 11, the upper projection 74 of the terminal 26 lies in the region occupied by the door projection 90 in the closed position. If the door is moved toward the closed position, the projection 90 engages the projection 74 as illustrated in FIG. 12 so that the door cannot be closed. This provides a clear indication that the terminal 26 must be further inserted before use of the connector 20.

With reference now to FIGS. 13 and 14, there is illustrated a housing generally designated as 110 of a connector comprising another embodiment of the present invention. Housing 110 is adapted to be used with terminals identical to the terminals 26 described in detail above. In many respects the housing 110 is similar to the housing 24 described above in connection with the connector 20, and similar reference numerals are used in FIGS. 13 and 14 to designate similar portions of the structure.

Housing 110 differs from the housing 24 of connector 20 principally in the configuration of the secondary lock structure, and more specifically in the configuration of the housing door portion. Housing 110 includes a door 112 including individual projections 114, one corresponding to each of the terminal receiving cavities 38. Each projection 114 is provided with a camming surface 116 for carrying out the function of advancing a partly inserted terminal 26 from a position closely adjacent the home position to the home position. As best seen in FIG. 13, the upper portion of housing 110 above the entrance regions 40 of the cavities 38 is contoured to receive the individual projections 114. The terminal receiving regions 40 include upper slots 118 opposite the lower slots 94, and the upper slots 118 extend throughout the length of the entrance portions 40.

Since with the embodiment of the invention illustrated in FIGS. 13 and 14 it is not necessary to remove all of the material between adjacent entrance portions 40 at the end of the housing, it is possible to include door latching structure between the ends of the housing. Consequently, the housing 110 is provided with latching protuberances 88 between each cavity 38 in addition to the protuberances 88 disposed at opposite ends of the housing. Moreover, the U-shaped wall portion 82 of the latch arrangement 80 is provided with slots 86 corresponding to each protuberance 88. When door 112 is moved to the closed position, the latching of the door at many positions assures firm engagement of the door, and this configuration may be useful when a large number of terminal receiving cavities are arranged in a single row.

With reference now to FIGS. 15 and 16 there is illustrated a connector housing generally designated by the reference numeral 130 of an electrical connector comprising yet another embodiment of the present invention. Housing 130 is adapted to receive terminals identical with the terminals 26 described above. In many respects, the housing 130 is similar to the housing 24 described above in connection with connector 20, and similar reference numerals are used to designate similar structure.

The housing 130 differs from the housing 24 in that it includes two rows of four terminal receiving cavities 38, rather than a single row. The housing 130 is provided with a pair of doors 76 each associated with one of the rows of cavities 38 and hinged to opposite sides of the housing 130. Thus, it can be seen that through the use of multiple rows of cavities, the principles of the present invention may be utilized in connectors accommodating a large numer of terminals.

With reference now to FIGS. 17 and 18, there is illustrated an electrical connector designated as a whole by the reference numeral 140 and comprising another embodiment of the present invention. In many respects, the connector 140 is similar to the connector 20 described above with reference to FIGS. 1–12. Similar reference numerals are utilized to designate similar structure. Although the connector 140 is illustrated only in section wherein only a single terminal receiving cavity 38 is shown, it should be understood that the connector 140 may include four or fewer or more cavities 38.

In accordance with an important feature of the present invention, the connector 140 includes provision for an intermediate assembled position of the terminals 26 within terminal receiving cavities 38. More specifically, each cavity 38 is provided with a bore portion 142 having an outer segment 144 of a relatively smaller diameter and an inner segment 146 of a slightly larger diameter. Segments 44 and 46 are divided by an intermediate shoulder 148.

In assembly of the connector 140, when terminals 26 attached to wire conductors 22 are inserted into the corresponding cavities 38, the terminals may initially be inserted only to the intermediate position illustrated in FIG. 17. In this position, the locking tangs 72 move through the outer segment 144 of the bore 142 and into the inner segment 146. The tangs 72 expand outwardly and engage the intermediate shoulder 148 so that even though the terminal 26 is not fully inserted, nevertheless withdrawal is prevented by engagement of the tangs 72 with the intermediate shoulder 148.

After all of the terminals 26 associated with the connector 140 are inserted to the intermediate position, the secondary locking structure 70 may be utilized to complete the insertion of all of the terminals 26 simultaneously. The spacing of the intermediate shoulder 148 from the inner shoulder 46 is such that in the intermediate position of the terminals 26, the secondary locking structure is capable of advancing the terminals to the fully inserted, home position. When the door 76 is moved to the closed position illustrated in FIG. 18, the camming surface 98 engages the upper terminal projection 74, in the manner described above in connection with the connector 20, and further inserts each terminal 26 from the intermediate position of FIG. 17 to the fully inserted position of FIG. 18.

Having reference now to FIGS. 19 and 20, there is illustrated an electrical connector designated as a whole by the reference numeral 160 and comprising another embodiment of the present invention. The connector 160 is similar in some respects to the connector 20 described above and similar reference numerals are used to designate similar structure.

In general, the connector 160 includes one or any desired number of terminals 162 received in terminal receiving cavities 164 of a connector housing generally designated as 166. Connector 160 differs from connector 20 in that it utilizes another form of primary lock structure generally designated by the reference numeral 168 and secondary lock structure generally designated by the reference numeral 170 cooperating with one another in novel manner to retain the terminals 162 in the housing 166.

More specifically, each terminal 162, one of which is illustrated in FIGS. 19 and 20, is similar in many respects to the terminal 26 described above. However, the terminal 162 need not include locking tangs such as the tangs 72 of the terminal 26.

The primary locking of terminal 162 in cavity 164 is accomplished in the connector 160 by positioning of the lowermost wing-like terminal projection 74 in a recess 172 in the entrance regions 40 of the cavity 164. Recess 172 is aligned with the lower guide slot 74, and as the terminal is moved into position as illustrated in FIG. 9, the lower projection 74 of the terminal is guided into position over the recess 172.

The secondary lock structure 170 of connector 160 includes a door 174 of the housing 166. Door 174 includes a projection 176 which enters and obstructs the entrance region 40 when the door is moved to the closed position illustrated in FIG. 20. In this position, a lower abutment surface 178 of the door projection 176 engages the upper wing-like projection 74 of the terminal thereby to prevent the lower projection 74 from being moved out of the recess 172.

Although the door projection 176 prevents transverse movement of the terminal, movement of the terminal along its axis from the home position illustrated in FIG. 20 is prevented by engagement of the lower projection 74 with the forward and rear ends of the recess 172. The forward end of the recess in the illustrated arrangement comprises an extension of the outer shoulder 48. The rear end of the recess 172 is defined by a shoulder 180. It should be noted that pushing or pulling forces applied to the terminal 162 or to the wire conductor 22 are applied to the surfaces 48 and 180, and not to the door 174.

Although the invention has been described with reference to the illustrated embodiments, many other modifications and embodiments may be devised by those skilled in the art. Details of the illustrated embodiments are not intended to limit the present invention as defined in the following claims.

What is claimed and desired to be secured by Letters Patent of the United States is:

1. An electrical connector comprising in combination:

a housing formed of insulating material and including a main body portion and a hinged door portion movable to closed and open positions;

at least one terminal-receiving cavity extending through said main body portion, said cavity including an entrance region;

a conductive terminal insertable into said cavity from said entrance region to a home position;

said terminal comprising a generally cylindrical body having a pair of projections extending radially from said terminal and lying approximately in a plane including the center of said body;

primary lock means on said terminal and main body portion effective upon movement of said terminal to the home position for retaining the terminal in place;

guide groove means in said main body portion along the entrance region of said cavity for receiving said projections and guiding said terminal to said home position with said projections in a predetermined position; and said door including a segment received in said entrance region upon closing of said door and engagable with one said projection in said predetermined position, said door segment and said projections including camming means for advancing said terminal from a position closely adjacent the home position to the home position upon closing of said door.

2. The connector of claim 1, said projections being constructed and arranged to prevent closing of said door unless said terminal is in or closely adjacent the home position.

3. An electrical connector comprising in combination a housing formed of insulating material, a terminal receiving cavity in said housing including an entrance region and a bore portion of reduced cross sectional area adjacent said entrance region, first and second shoulders defining the ends of said bore portion, said bore portion having segments of different diameters separated by an intermediate third shoulder, a terminal insertable into said cavity through the entrance region to a home position, said terminal including a contact portion insertable through said entrance region and bore portion of said cavity, a conductor engaging portion, and a body portion between said contact portion and said conductor engaging portion, resilient forward lock means on said body compressible upon insertion of said body portion into said bore portion and engagable with said first shoulder for preventing withdrawal of said terminal from said cavity when in the home position, said resilient forward lock means being engagable with the third shoulder to prevent withdrawal of the terminal upon insertion of said terminal in said cavity to position spaced within a given distance from the home position, projection means on said body spaced from said forward lock means and engagable with said second shoulder for preventing overinsertion of said terminal, said body portion and said forward lock means and said projection means cooperating with said bore portion and said first and second shoulders fully to capture said terminal in said cavity, a door hinged to said housing for pivotal movement between open and closed positions, said door including a segment disposed in said entrance region overlying said projection means in the closed door position when the terminal is in the home position to capture said projection means between said second shoulder and said door segment, said projection means being constructed and arranged to engage said door segment and prevent closing of said door when said terminal is spaced a given distance from the home position, said door segment being constructed and arranged to engage said projection means and move said terminal to the home position upon closing of the door when said terminal is spaced less than said given distance from the home position.

4. An electrical connector comprising, in combination:

a housing formed of insulation material, said housing including a body portion having a top surface with a recess formed therein, said recess having a forward area and a rearward area;

an elongated terminal receiving cavity formed in said housing, said cavity including an entrance region formed in the body portion;

a guide slot formed through the forward and rearward areas of the body portion recess and allowing communication between said entrance region and the outside of the housing above said recess;

a terminal insertable into said cavity through the entrance region, said terminal including a forward contact portion extending forward of said entrance region when said terminal is fully inserted in said cavity, a conductor engaging portion, a body portion between said contact portion and said conductor engaging portion, said body portion being receivable in said entrance region when said terminal is fully inserted in said cavity, and a projection formed on the body portion and being receivable in said guide slot, said projection being so positioned and extending a sufficient length from said body portion so that it will protrude through said slot above the forward area of the recess when said terminal is fully inserted in said cavity;

a door hinged to the top of the housing and movable between an open position and a closed position, said door including a depending protrusion adapted to be matingly received in the rearward area of the recess when said door is in the closed position, said door being unable to attain a closed position if said terminal projection is in the rearward area of said recess; and cam means cooperating between said projection and said door protrusion for moving said terminal in the cavity from a position short of a fully inserted position to a fully inserted position in response to moving said door from its open position to its closed position.

* * * * *